United States Patent [19]

Tanuma et al.

[11] Patent Number: 5,064,302

[45] Date of Patent: Nov. 12, 1991

[54] TEMPERATURE CONTROL IN A WIRE DOT PRINTER

[75] Inventors: Jiro Tanuma; Hideaki Ishimizu; Tadashi Kasai; Chihiro Komori, all of Minato, Japan

[73] Assignee: Oki Electric Industry Co., Ltd., Tokyo, Japan

[21] Appl. No.: 514,838

[22] Filed: Apr. 26, 1990

[30] Foreign Application Priority Data

May 1, 1989 [JP] Japan ..... 1-112565

[51] Int. Cl.[5] ..... B41J 2/30

[52] U.S. Cl. ..... 400/124; 400/54

[58] Field of Search ..... 400/54, 124, 124 TC, 400/719; 101/93.05

[56] References Cited

U.S. PATENT DOCUMENTS

| | | | |
|---|---|---|---|
| 4,778,293 | 10/1988 | Teshima et al. | 400/124 |
| 4,877,344 | 10/1989 | Watahiki et al. | 400/124 TC |

FOREIGN PATENT DOCUMENTS

| | | | |
|---|---|---|---|
| 0176732 | 4/1986 | European Pat. Off. . | |
| 0244604A3 | 11/1987 | European Pat. Off. . | |
| 3812622 | 11/1988 | Fed. Rep. of Germany . | |
| 38070 | 3/1984 | Japan | 400/124 TC |
| 59-111866 | 6/1984 | Japan . | |
| 48389 | 3/1985 | Japan | 400/54 |
| 87063 | 5/1985 | Japan | 400/54 |
| 62-64561 | 9/1985 | Japan . | |
| 249774 | 11/1986 | Japan | 400/124 TC |
| 13361 | 1/1987 | Japan | 400/124 TC |
| 62-189172 | 8/1987 | Japan . | |
| 189172 | 8/1987 | Japan | 400/719 |
| 189173 | 8/1987 | Japan | 400/719 |
| 62-263068 | 11/1987 | Japan . | |
| 162262 | 7/1988 | Japan | 400/124 TC |
| 1-4360 | 1/1989 | Japan . | |

*Primary Examiner*—David A. Wiecking

*Attorney, Agent, or Firm*—Wenderoth, Lind & Ponack

[57] ABSTRACT

A wire dot printer has a thermistor that detects the temperature of a print head and a counter that starts counting when the detection temperature exceeds an alarm temperature. The printer can be controlled by switching over between normal-printing and reduced-character-printing in which a reduced number of print wires is used. When the detection temperature exceeds the alarm temperature, the printer will first stop and then control the print head in such a way as to reduce the temperature. Once the temperature drops back down below the alarm temperature, the printer will perform reduced-character-printing for a definite period of time based on the length of time from when the temperature exceeded the alarm temperature to when the temperature dropped back down below the alarm temperature. By increasing the length of time in which reduced-character-printing is carried out, the amount of heat given off by the print head decreases. Furthermore, by basing the time over which reduced-character-printing is performed on the length of time that the alarm temperature was exceeded. It is possible to set the reduced-character-printing time to an appropriate length such that the print head does not overheat and throughout is not excessively impaired.

5 Claims, 5 Drawing Sheets

TEMPERATURE CONTROL IN A WIRE DOT PRINTER

BACKGROUND OF THE INVENTION

The invention relates to wire dot printers which print by a dot impact method.

Prior-art wire dot printers have a problem in that, upon continuous printing, print heads occasionally overheat due to heat generation from print head coils; this can lead to poor printing, component deterioration, and even component damage. To prevent this from occurring, control methods have been implemented by doing such things as installing a thermistor inside the print head and, in accordance with its output signal, performing "reduced-character-printing" and/or "printing-suspension" (i.e., temporarily stopping the print operation). By "reduced-character-printing," we refer to a printing process in which fewer (relative to normal printing, in which one row of characters is printed in one pass of a print head) print wires are driven and in which, for example, one row of characters is printed in one reciprocal pass (i.e., one forward pass and one backward pass) of the dot head. Here, we use the term "two-pass-printing" to indicate the printing of one row of characters by one reciprocal pass of a print head.

However, should the time that the printer is stopped be too long, a user may be displeased by the delay or start worrying that the printer is broken. In addition, there are times when reduced-character-printing is not sufficient to fully suppress a rise in print-head temperature. For these reasons, drive methods, like that shown in the flowchart of FIG. 1, have been developed which combine printing-suspension and reduced-character-printing. Here, FIG. 2 shows a graph of a change in print-head temperature T when controlled as in FIG. 1; and FIG. 3 shows the cumulative amount of printed characters W when controlled as in FIG. 1.

In the prior art, when a print-head temperature T is equal to or less than a previously set alarm temperature A, Step 21 ("S21" in FIG. 1; subsequent steps treated similarly) through Step 23 are performed repeatedly; and, as a result, normal printing is carried out. Normal printing is shown by, for example, the interval from time "0" to time "n" in FIGS. 2 and 3. During normal printing, temperature T gradually rises. When temperature T exceeds the alarm temperature A, the number of spontaneously driven print wires is halved and two-pass printing is begun. At Step 24, counting is started with a counter, hereafter referred to as the "C-counter," at the start of two-pass printing. Until a C-counter value, hereafter referred to as "count-value-c," exceeds a maximum-stop-time M at Step 25, two-pass printing is carried out at Step 26. Two-pass printing is shown by, for example, the interval from time "n" to time "p" in FIGS. 2 and 3. Should count-value-c exceed the maximum-stop-time M, or, in other words, should temperature T not become equal to or less than the alarm temperature A within a set time, the processing proceeds from Step 25 to Step 27; and printing is suspended. A printing-suspension is shown by, for example, the interval from time "p" to time "q" in FIGS. 2 and 3.

However, in this case as well, there is a fear that this delay may displease a user or make a user start worrying that the printer is broken. Furthermore, since the duration of the printing-suspension is long, one may have trouble obtaining sufficient printer throughput.

Moreover, with the dot print-head having multiple print wires, there is a well-known problem in that, because drive-coil magnetic-circuits of the individual print wires interfere with each other, as the number of print wires simultaneously driven increases, the energy required to drive each print wire increases. Consequently, as the number of driven print wires is increased, the amount of heat given off by each drive-coil also increases, as does the heat given off by the print head as a whole.

SUMMARY OF THE INVENTION

It is an aim of the invention to provide a wire dot printer with a high throughput and that does not impart to a user a displeasure or a worry due to printing-suspensions.

For this reason, a printer of the invention has: multiple print wires which strike printing paper; a print head having the multiple print wires; a drive circuit that drives the print head; a thermistor that detects a temperature of the print head; a measurement means that measures the elapsed time from when a detection temperature of thermistor exceeds a previously set alarm temperature; and a control circuit that changes over, in accordance with a value of the counter, between normal printing, in which all print wires can be utilized, and reduced-character-printing, in which a decreased number of spontaneously driven print wires are utilized. Furthermore, the printer, when a detection temperature of the thermistor exceeds the alarm temperature, acts, with the control circuit, so as to lower the detection temperature. In addition, the printer, when the detection temperature of the thermistor goes below the alarm temperature, executes reduced-character-printing for a definite duration based on an elapsed time that starts when the detection temperature of the thermistor exceeds the alarm temperature and ends when the detection temperature becomes less than the alarm temperature.

In this way, by continuing reduced-character-printing even after the detection temperature of the thermistor becomes less than the set alarm temperature, the time over which reduced-character-printing (i.e., printing in which few print wires are simultaneously driven) is increased. In addition, since reduced-character-printing acts to lower magnetic interference between drive coils, as a result, through a characteristic of wire dot printers which states that, as magnetic interference between drive coils decreases, the energy needed to drive each print wire also decreases, heat radiated by the print head as a whole is reduced. In other words, a printer of the prior art resumes normal printing when a thermistor detection temperature becomes equal to or less than an alarm temperature; however, in such a case (i.e., when a thermistor detection temperature becomes equal to or less than an alarm temperature), a printer of the invention continues reduced-character-printing, in which the drive energy required for each drive wire is less; and thereby, for the same amount of print, a printer of the invention will emit less heat.

Furthermore, the duration of reduced-character-printing is made to an appropriate length by basing on the elapsed time from when the detection temperature exceeded the alarm temperature to when the detection temperature became less than the alarm temperature. That is, for example, when it takes a long time for the thermistor detection temperature to fall back below the alarm temperature after having exceeded the alarm temperature, it can be inferred that high density printing (for example, text with tightly packed characters, graphics, and the like) is being performed; the duration of reduced-character-printing can then be extended as appropriate, and heat generation suppressed accordingly.

DETAILED DESCRIPTION OF THE INVENTION

The invention is explained below in reference to the figures.

Figure 4:
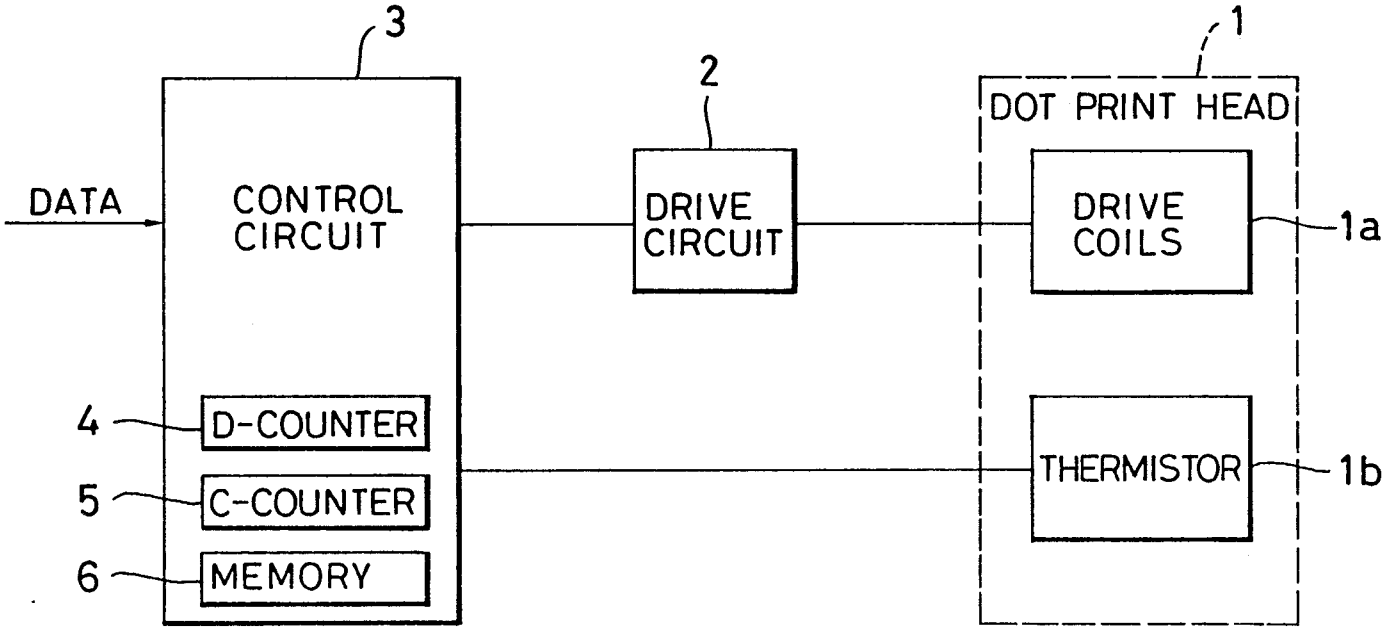
FIG. 4 is a block diagram revealing the configuration of an embodiment of a wire dot printer relating to the invention.

As shown in FIG. 4, a printer of the embodiment comprises: a dot print head 1, having multiple print wires (not shown in the drawing) which perform dot printing by striking, either directly or through an ink ribbon, a printing paper; a drive circuit 2, which drives this dot print head 1; and a control circuit 3, which controls this drive circuit 2.

The dot print head 1 comprises, in addition to print wires, armatures (not shown in the drawing) which support the print wires respectively; flat springs (not shown in the drawing) which push outward the print wires respectively; permanent magnets which operate the armatures by magnetic force and draw the print wires into a print head case; and drive coils which cancel out a magnetic field of the permanent magnets when an electric current is applied. By this, when an electrical current is not flowing through drive coil 1*a*, the print wire is pulled into a case of the dot print head 1 by a magnetic force; when an electric current is applied, the magnetic field is cancelled out, which releases the print wire from the magnetic force whereby the print wire sticks out from the case of dot print head 1 through an action of a flat spring.

Furthermore, the dot print head 1 has a thermistor 1*b* as a temperature detection means to detect a temperature of the dot print head 1 itself.

The drive circuit 2 supplies, in accordance with control signals from control circuit 3, respective drive currents to multiple drive coils 1*a* attached to the dot print head 1.

The control circuit 3 comprises, for example, a microcomputer and a memory, which stores a program for controlling an action of the drive circuit 2 to drive the dot print head 1. In addition, in this embodiment, the control circuit 3 has a previously set alarm temperature and a D-counter 4, which measures an elapsed time from when a detection temperature of thermistor 1*b* exceeds an alarm temperature. Also, the control circuit 3 has a C-counter 5 for determining a duration for multiple-pass-printing (described in detail later). Moreover, the control circuit 3 has a memory 6 that stores data for calculation.

Furthermore, the control circuit 3 controls by changing over, in accordance with a detection temperature of thermistor 1*b*, between normal-printing, in which all print wires of the dot print head 1 are driven, and multiple-pass-printing (also called reduced-character-printing), in which a decreased number of spontaneously driven print wires of the dot print head 1 are used and one line of characters is printed by multiple printing passes.

The control of the control circuit 3 will be described below in detail in reference to FIGS. 4 through 7. Here, c is a count value (count-value-c) of C-counter 5, d is a count value (count-value-d) of D-counter 4, T is a temperature detected by thermistor 1*b*, A is a previously set alarm temperature, E is a content of memory 6, and N is a maximum-stop-time permitted for continuous stoppage.

Figure 5:
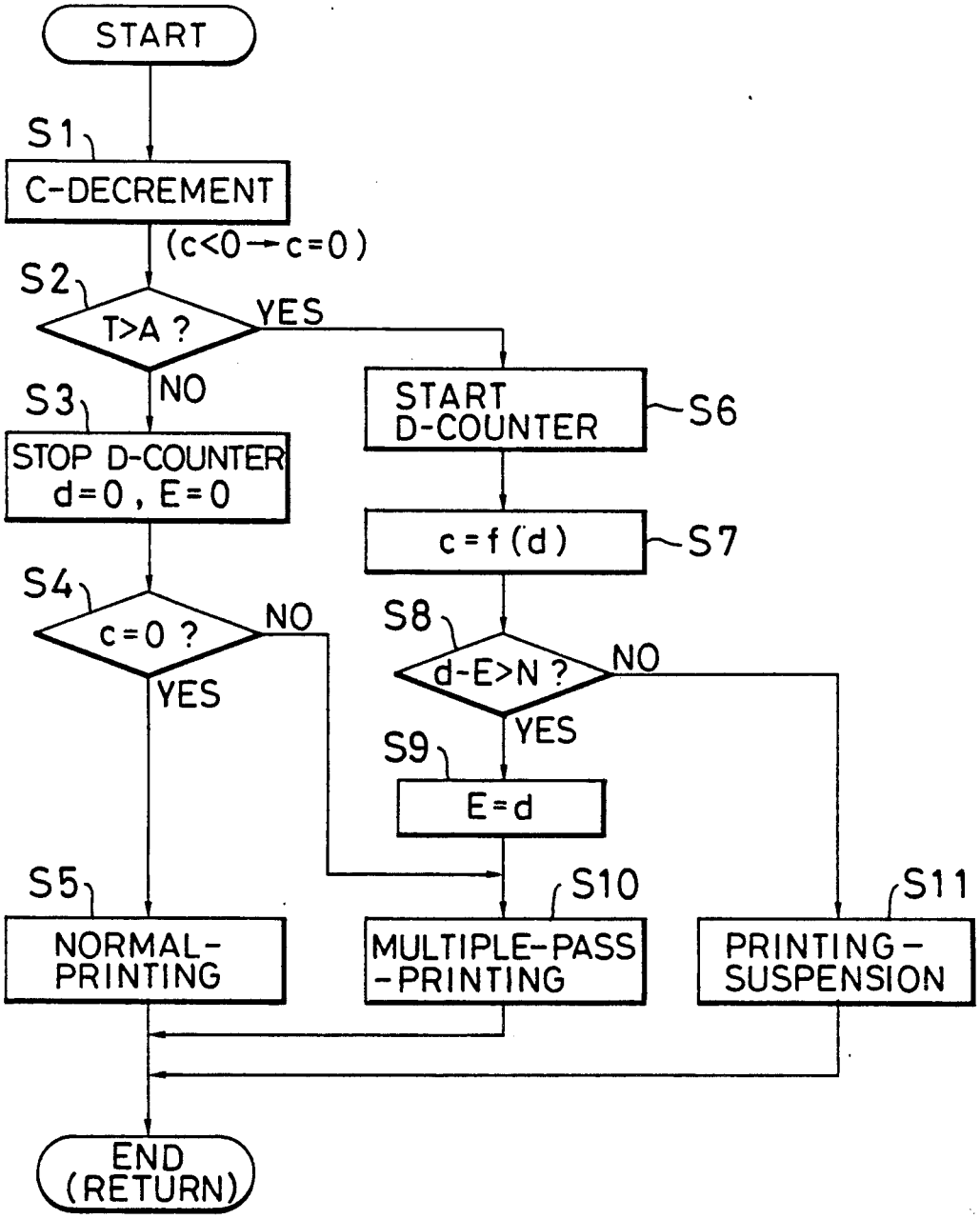
FIG. 5 is a flowchart delineating the action of the embodiment of FIG. 4.

As shown in FIG. 5, the embodiment decrements counter-value-c of C-counter 5 at Step 1 (referred to as "S1" in the figure; subsequent steps treated similarly) at a constant time interval. The count-value-c of C-counter 5 is used to determine the duration of multiple-pass-printing: it is 0 at the start of printing. A decrement of the counter advances independently of any other action shown in this flowchart. Also, if the count-value-c of C-counter 5 has dropped below 0 (i.e., if $C<0$), the count-value-c will be reset to zero.)

At Step 2, a judgement is made as to whether or not the detection temperature T has exceeded the alarm temperature A. If the detection temperature T is less than or equal to the alarm temperature A, a judgement of "No" is returned; and processing proceeds to Step 3.

At Step 3, the D-counter 4 is stopped if it is counting (there are cases when the D-counter will already be stopped as, for example, right after the start of printing), count-value-d is reset to 0, data value E of memory 6 is set to 0, and the processing proceeds to Step 4.

At Step 4, a judgement is made as to whether or not the count-value-c of C-counter 5 is 0. Since this value was set to 0 ($c=0$) at the start of printing, a judgement of "Yes" is made, and processing proceeds to Step 5, and normal-printing is performed. After Step 5, processing returns to Step 1; and, as long as the judgement of Step 2 is "No" and the judgement of Step 4 is "Yes," the process from Step 1 to Step 5 will be repeated. In this way, normal-printing, in which the number of driven print wires is not reduced, will generally be performed for a while after the start of printing. This normal-printing will continue, for example, from time "0" to time "a" in FIGS. 6 and 7.

Figure 6:
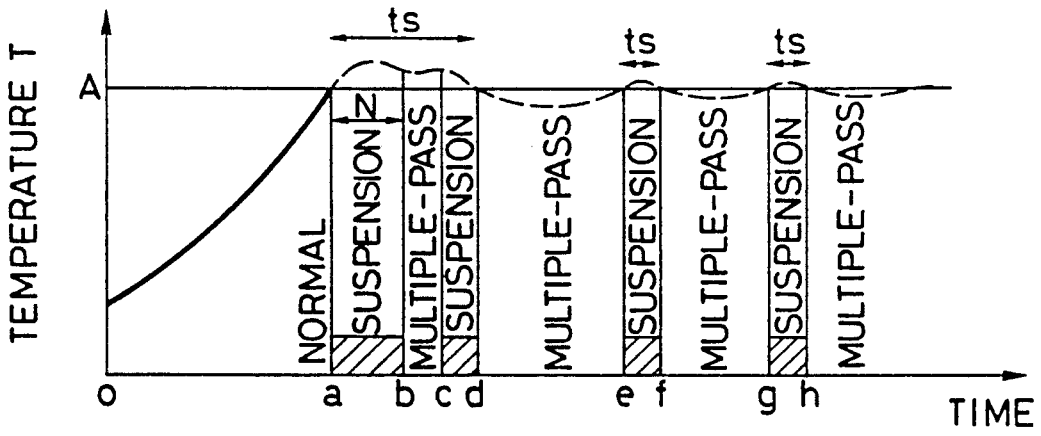
FIG. 6 is a graph portraying the time-dependent change in print-head temperature T of the embodiment of FIG. 4.
Figure 7:
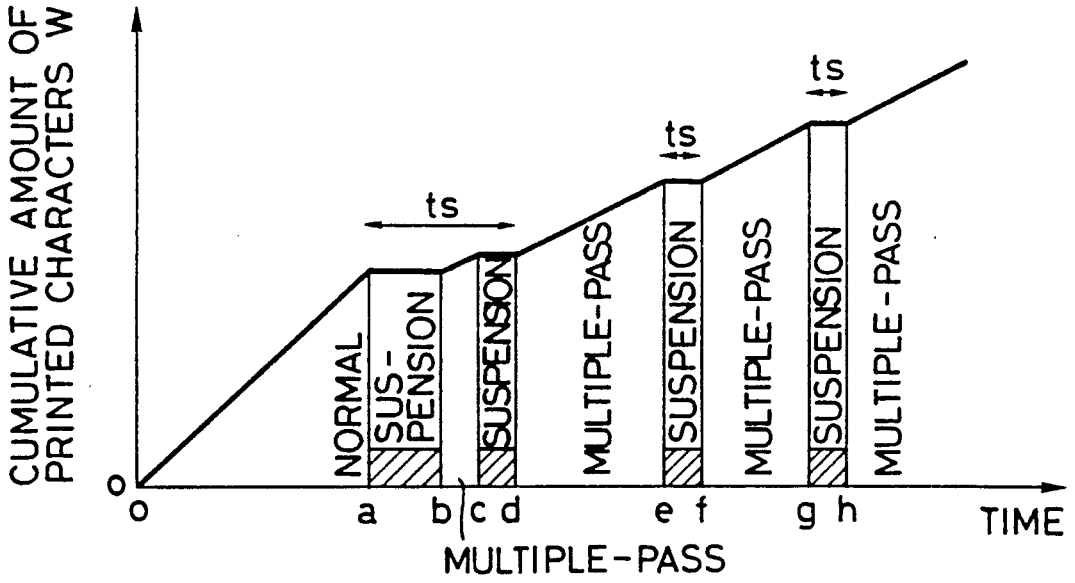
FIG. 7 is a graph picturing the cumulative amount of printed characters W when driving the embodiment of FIG. 4.

However, as can be seen in the interval from time "0" to time "a" in FIG. 6, the detection temperature T of thermistor 1*b* increases with time. Should the detection temperature T exceed the alarm temperature A and a judgement of "Yes" be returned at Step 2, processing will proceed to Step 6. At Step 6, the D-counter 4 operates, and, by this, the D-counter 4 increments count-value-d at a constant time interval. This counting action will be continued until stopped at Step 3.

At Step 7, a value is assigned to count-value-c of the C-counter 5. Specifically, a value of c is calculated from a function c=f(d), i.e., a value of c is determined based on count-value-d, itself corresponding to an elapsed time $t_s$, which is the time elapsed since measurement temperature T exceeded alarm temperature A. The function f(d) is given by, for example, f(d)=d×K1+K2 (where K1 and K2 are positive integers). Other expressions may also be used. Here, K1 is from 1 to 4 minutes, K2 is from 0 to 5 minutes, the maximum-print-stop-time N is from 3 to 30 seconds, and the number of multiple passes is from 2 to 4.

At Step 8, a judgement will be made as to whether or not a value resulting from a subtraction of E from d (i.e., d−E) is greater than the maximum-stop-time N; if the value (d−E) is less than or equal to the maximum-stop-time N, then a judgement of "No" will be returned, and processing will proceed to Step 11, and printing will be suspended (for the interval between time a and time b of FIG. 6). Here, the value E is a datum for determining if the print-stop-time has reached the maximum-stop-time N. Therefore, the value (d−E) shows (for a case where E is not equal to 0) the elapsed time (print-stop-time) after the completion of multiple-pass-printing. Thus, the process is executed repeatedly in the order of Step 1, Step 2, Step 6 through Step 8, and Step 11.

If, in the process of going from Step 1, Step 2, Step 6 through Step 8, and then to Step 11, a judgement of "Yes" is returned at Step 8, then, at Step 9, the data value E of memory 6 is set to d and, at Step 10, multiple-pass-printing is performed for one line only (over time "b" to time "c" in FIG. 6); after that, printing is suspended once again (over time "c" to time "d" in FIG. 6). Here, the reason for performing multiple-pass-printing in such a manner is, to avoid making the print-stop-time too long, so as to avoid displeasing a user or making a user start to worry that the printer is broken.

Also, once a value is set for c in Step 7, should processing proceed from Step 1 to Step 4, the judgement at Step 4 will stay as "No" until the c value is reduced by the C-counter down to 0; therefore, the multiple-pass-printing of Step 10 will be continued (over the interval in FIG. 6 from time "d" to time "e").

Furthermore, if at time "e" shown in FIG. 6, the print head temperature T once again exceeds alarm temperature A, processing will proceed in the order of Step 1, Step 2, Step 6, Step 7, Step 8, and Step 11 (all of FIG. 5); whereupon printing will be suspended (from time "e" to time "f"). When the print head temperature T falls below the alarm temperature A, processing will proceed in the order of Step 1, Step 2, Step 3, Step 4, and Step 10; whereupon multiple-pass-printing will be performed (from time "f" to time "g"). Furthermore, although not shown in FIG. 6, when multiple-pass-printing is performed over a time longer than a certain set time, c will become 0, and processing will proceed in the order of Step 1, Step 2, Step 3, and Step 4; whereupon normal-printing will be performed.

Figure 1:
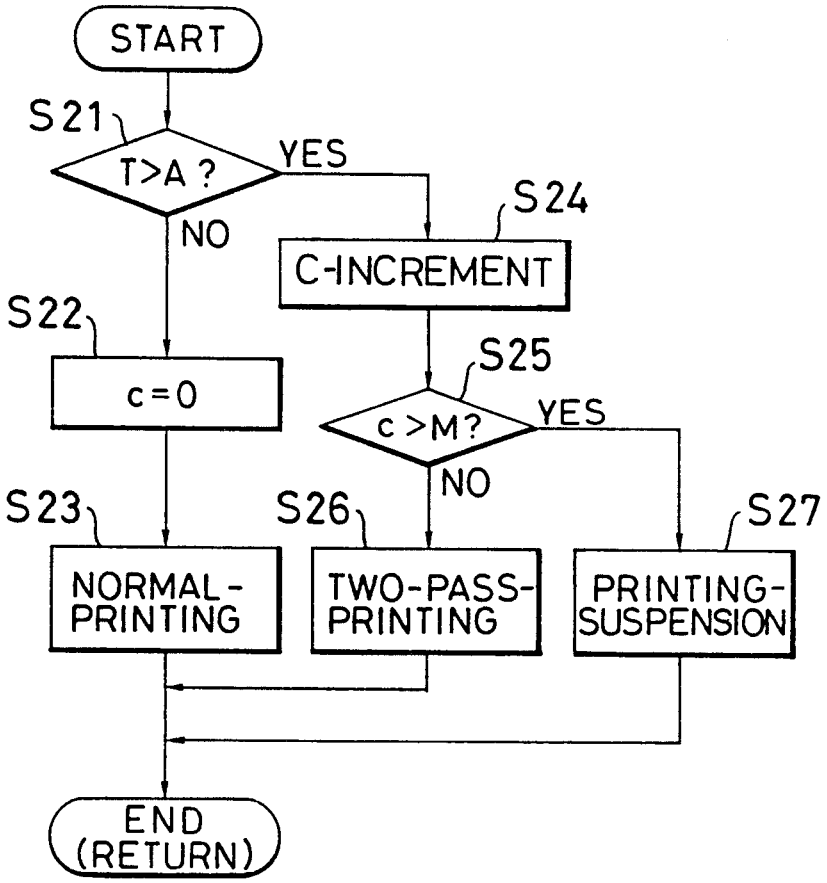
FIG. 1 PRIOR ART
FIG. 1 is a flowchart showing the action of a prior-art wire dot printer.
Figure 2:
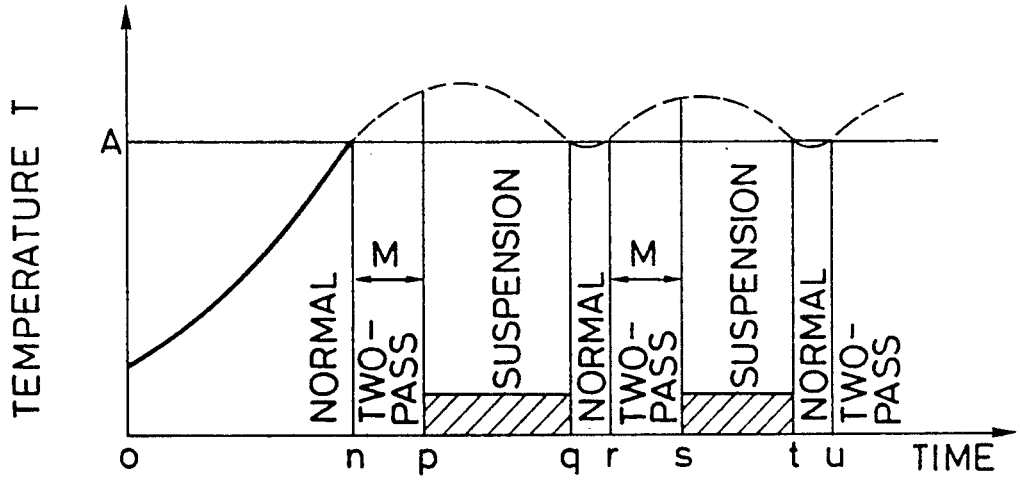
FIG. 2 PRIOR ART
FIG. 2 is a graph depicting the time-dependent change in print-head temperature T when driving the wire dot printer of FIG. 1.
Figure 3:
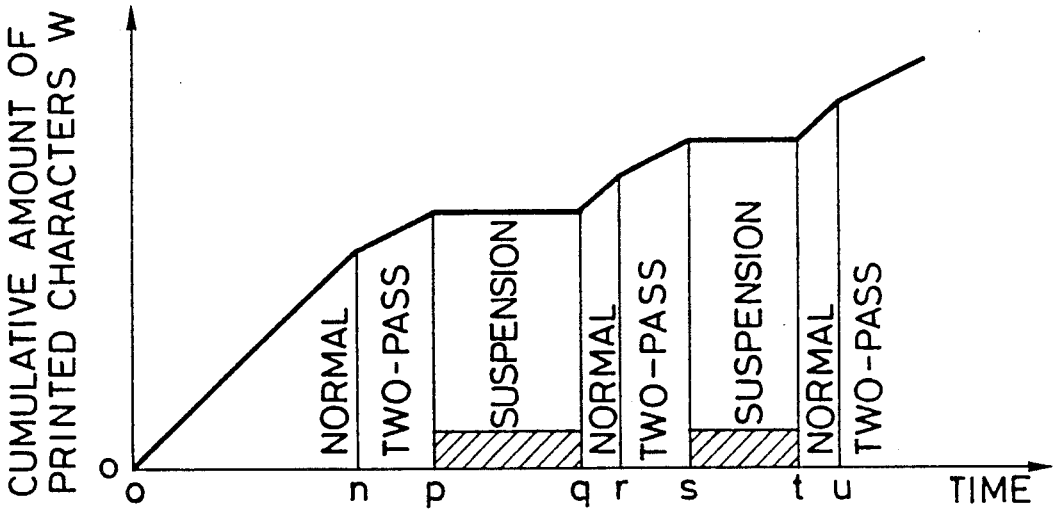
FIG. 3 PRIOR ART
FIG. 3 is a graph illustrating the cumulative amount of printed characters W when driving the wire dot printer of FIG. 1.

As described above, even if the detection temperature of the thermistor 1*b* becomes less than the alarm temperature A, normal-printing will not be performed as it is with the prior art example of FIG. 2; rather, multiple-pass-printing will be performed for a definite duration based on an elapsed time $t_s$ which extends from the time when the detection temperature T exceeded the alarm temperature A to the time that the detection temperature T fell below the alarm temperature A. In this way, by increasing the proportion of multiple-pass-printing, which utilizes a decreased number of simultaneously driven print wires, one can prevent overheating of the dot print head 1 and raise the throughput.

Also, an upper limit of multiple-pass-printing time is a time based on the print-stop-time $t_s$ over which the detection temperature exceeded the alarm temperature. A long stop-time $t_s$ can be interpreted as meaning that high-density printing, or, in other words, printing that generates much heat, as is the case with text having tightly packed characters, is being carried out; thus, in order to suppress heat generation, multiple-pass-printing time can be lengthened and a return to normal-printing can be delayed.

Furthermore, when this time $t_s$ is short, it can be considered that low-density printing is being performed; therefore, multiple-pass-printing time can be reduced, control can be quickly returned to normal-printing, and the throughput can be increased.

Also should driving of dot print head 1 be stopped because the detection temperature T of thermistor 1*b* exceeded the alarm temperature A, and should this stop-time exceed a previously set maximum-stop-time, multiple-pass-printing will be performed for a definite duration based on this stop-time; and by this, the dot print head 1 will not overheat. Furthermore, since continuous and long printing stoppages are avoided, a user can tell that the printer is in a print mode; thereby preventing a user from becoming displeased or worried.

For the embodiment, we discussed a case in which counters were used as a measurement means for measuring print stop time; however, the embodiment is not limited to this: a dedicated timer is also acceptable; and furthermore, it is also possible to measure the number of printing lines and use that measurement result as time data.

In order to prevent drive coil overheating, it is also possible to establish two alarm temperature levels; and, when the lower alarm temperature is exceeded, to reduce the amount of printing over a constant period; and, when the upper alarm temperature is exceeded, to perform multiple-pass-printing and to perform printing-suspension over a constant period.

Furthermore, the embodiment is very effective when the printing density is high as is the case with graphics and such. Therefore, a configuration can also be effected so that control can be changed over between the prior art control mode of FIG. 4 and the control mode of the embodiment in accordance with what is to be printed.

What is claimed is:

1. A wire dot printer comprising:

a dot print head having multiple print wires which strike printing paper;

a drive means for driving said dot print head;

a temperature detection means for detecting a temperature of said dot print head;

a measurement means for measuring an elapsed time from when a detection temperature of said temperature detection means exceeds a previously set alarm temperature; and a control means for controlling by changing over, in accordance with a measurement result of said measurement means, between normal-printing, in which all print wires can be driven, and reduced-character-printing, in which a decreased number of spontaneously driven print wires are used;

wherein, when a detection temperature of said temperature detection means exceeds said alarm temperature, said control means causes said drive means to drive said dot print head in such a way so as to lower the temperature of said dot print head and, when the detection temperature of said temperature detection means goes below said alarm temperature, said control means executes reduced-character-printing for a definite duration based on an elapsed time starting when the detection temperature of said temperature detection means exceeds said alarm temperature and ending when said detection temperature becomes less than said alarm temperature.

2. A wire dot printer in accordance with claim 1, wherein said temperature detection means is a thermistor.

3. A wire dot printer in accordance with claim 1, wherein said reduced-character-printing is multiple-pass-printing in which one row is printed in multiple passes of said dot print head.

4. A wire dot printer in accordance with claim 1, wherein said driving of said dot print head by said driving means is suspended so as to lower said temperature of said dot print head when said detection temperature of said temperature detection means exceeds said alarm temperature.

5. A wire dot printer in accordance with claim 4 further comprising:

a counter for decrementing a value by one at a constant period and in accordance with said duration of the suspension of printing and for continuing said reduced-character-printing until said value of said counter becomes equal to zero; and thereupon performing normal-printing.

* * * * *